US009303880B1

(12) United States Patent
Tomlinson et al.

(10) Patent No.: US 9,303,880 B1
(45) Date of Patent: Apr. 5, 2016

(54) RADIANT TUBE HEATER

(71) Applicant: L. B. White Company, Inc., Onalaska, WI (US)

(72) Inventors: John L. Tomlinson, Onalaska, WI (US); Thomas C. Simon, Maple Lake, MN (US)

(73) Assignee: L.B. White Company, Inc., Onalaska, WI (US)

( * ) Notice: Subject to any disclaimer, the term of this patent is extended or adjusted under 35 U.S.C. 154(b) by 568 days.

(21) Appl. No.: 13/860,096

(22) Filed: Apr. 10, 2013

Related U.S. Application Data

(60) Provisional application No. 61/622,117, filed on Apr. 10, 2012.

(51) Int. Cl.
*F24D 5/08* (2006.01)
*F23D 14/12* (2006.01)

(52) U.S. Cl.
CPC ..... *F24D 5/08* (2013.01); *F23D 14/125* (2013.01)

(58) Field of Classification Search
CPC ..... F24D 5/08; F23D 14/125; F23D 14/12; F23D 2900/14121; F24C 3/045
See application file for complete search history.

(56) References Cited

U.S. PATENT DOCUMENTS

| | | | |
|---|---|---|---|
| 1,393,368 | A | 10/1921 | Henry |
| 2,439,038 | A | 4/1948 | Cartter |
| 2,759,472 | A | 8/1956 | Cartter |
| 2,946,510 | A | 7/1960 | Galvin |
| 3,220,401 | A | 11/1965 | Jones et al. |
| 3,225,757 | A | 12/1965 | Keller |
| 3,310,047 | A | 3/1967 | Budden |
| 3,733,461 | A | 5/1973 | Rohats |
| 3,920,383 | A | 11/1975 | Kerr |
| 4,319,125 | A | 3/1982 | Prince |
| 4,582,042 | A | 4/1986 | Kubler |
| 4,645,450 | A | 2/1987 | West |
| 4,676,222 | A | 6/1987 | Jones et al. |
| 4,712,734 | A | 12/1987 | Johnson |
| 4,727,854 | A | 3/1988 | Johnson |
| 4,869,229 | A | 9/1989 | Johnson |
| 5,112,217 | A | 5/1992 | Ripka et al. |
| 5,353,986 | A | 10/1994 | Wortman et al. |
| 6,138,662 | A | 10/2000 | Jones |
| RE37,636 | E | 4/2002 | Wortman et al. |
| 6,505,099 | B1 | 1/2003 | Brice et al. |
| 6,971,871 | B2 | 12/2005 | Ahmady |
| 7,293,606 | B2 | 11/2007 | Benoit et al. |
| 7,913,683 | B2 | 3/2011 | Schwank et al. |
| 8,105,077 | B2 | 1/2012 | Bannos et al. |
| 8,166,964 | B2 | 5/2012 | Longueville et al. |
| 2011/0042369 | A1 | 2/2011 | Ishiguro et al. |

FOREIGN PATENT DOCUMENTS

| | | |
|---|---|---|
| GB | 2189314 | 10/1987 |

*Primary Examiner* — Alfred Basichas
(74) *Attorney, Agent, or Firm* — Charles S. Sara, Esq.; DeWitt Ross & Stevens S.C.

(57) ABSTRACT

A radiant tube heater, primarily for agricultural buildings and preferably intended for poultry breeding buildings, includes a burner box or heat creator, which is an enclosure with pressurized and non-pressurized sides, a gas control valve and orifice assembly; ignition control and components, a burner assembly, and an air proving switch. Attached to the burner box is a heat distributor which includes a radiant heating tube unit. The radiant heating tube unit is comprised of an elongated two-section tube extending from the burner box, wherein the first tube has a round cross section and a cross section having a diameter less than the width of the second tube. The second tube is characterized by having a non-round or oblong, preferably oval cross section, wherein one set of opposing sides of the oblong tube are longer than the ends of the tube. A transition piece connects the first tube with the section tube. An open reflector is situated for reflecting the radiant heat to a desired location.

28 Claims, 8 Drawing Sheets

RADIANT TUBE HEATER

CROSS-REFERENCE TO RELATED APPLICATION

This application claims priority under 35 USC §119(e) to U.S. Provisional Patent Application 61/622,117, entitled "Radiant Tube Heater," filed Apr. 10, 2012, in the name of John L. Tomlinson and Thomas C. Simon, the entirety of which is incorporated by reference herein.

FIELD OF THE INVENTION

The present invention is directed to a radiant tube heater and specifically a radiant tube heater for animal confinement buildings. More specifically, the present invention is directed to a radiant tube heater for heating poultry confinement buildings.

BACKGROUND

Radiant tube heaters are compact, self-contained direct heating devices. They can be used to heat factories, warehouses, foundries, gymnasiums, loading docks, race track stands, arena bleachers, outdoor restaurants, swimming pool surrounds and many other areas. Radiant tube heaters can also be used for snow melting and de-icing, as well as in car washes and other environments.

Infra-red energy is a form of electromagnetic (EM) radiation. It makes up a portion of the electromagnetic spectrum and has wavelengths close to the wavelengths of visible light, but infra-red energy cannot be seen by the human eye. Infra-red energy, like all EM radiation, travels in straight lines at the speed of light. EM radiation is line of sight, i.e., if the radiation source can be 'seen' by the object, the object will in turn receive the radiant energy.

Radiant tube heaters radiate infra-red energy which is absorbed by things with mass and whose surfaces are not highly reflective, such as floors and people. Intermediate transfer medium, such as air or water, are not needed nor are fans or pumps. As personnel, animals, floors and objects in the primary radiation pattern are warmed by the infra-red energy, they tend to transfer heat to the surroundings by conduction and convection.

In a radiant tube heater, an air and gas mixture enters the burner. Exhaust gases, generated by the combustion of air and gas, exit the burner. Positioned downstream of the burner is an elongated tube which carries the fan-blown hot air along the length of the elongated tube. As the hot air heats the tube, the tube begins to radiate heat to the surroundings. An open reflector, typically constructed of highly polished aluminum, further directs the infra-red rays to the target areas. Combustion contaminants are exhausted at the other end of the tube to the outside.

Radiant tube heaters provide several advantages over forced air heating systems, including lower fuel costs, less heat loss, faster heat generation, greater comfort at lower temperatures, out-of-the-way installation and unobtrusive operation.

There are already patents on radiant tube heaters. Most of these patents focus on the creation and management of the combustion, not the translation of that combustion heat in to radiant heat and transmission of radiant heat via the tube sizes or shapes coupled with a reflector shape. Reference is made to U.S. Pat. No. RE37,636 and its predecessor U.S. Pat. No. 5,353,986, both assigned to Detroit Radiant Products Company (Warren, Mich.). These patents are directed to 2-stage heat control in a radiant tube heater. Other prior-art patents include U.S. Pat. No. 4,645,450, assigned to Control Techtronics, Inc. (Harrisburg, Pa.), U.S. Pat. No. 5,112,217, assigned to Carrier Corporation (Syracuse, N.Y.), U.S. Pat. No. 4,869,229, and UK patent GB 2 189 314, assigned to Grayhill Blackheat LTD (United Kingdom).

A problem with the radiant heaters of the prior art is in the ability to control the amount and direction of heat to a desired location, generally the floor or lower area of a building. All radiant tube heaters discharge a certain amount of heat out the end of the tube, such that a tube heater is typically 70% or so efficient in taking input energy from the fuel and transforming that energy into useable radiant heat. Prior art heaters are intended largely for industrial applications where they are mounted high up in the structure. In a poultry house, for example, the ceiling height is relatively low, typically about 10 feet.

Further, radiant tube heaters typical of the prior art have higher tube temperatures at the start of the tube sections and lower tube temperatures towards the end of the tube sections resulting in variations in radiant energy over the length of the heater. Installing the radiant heater of the typical prior art in a poultry house results in excessively hot areas underneath the tubes at the start of the tube section with decreasing temperatures down the overall length. Additionally, tube heaters of the prior art when installed at the lower heights of a typical poultry house are limited in their ability to radiate heat sideways or across the house. This irregular 'egg shaped' heat pattern can be detrimental to the object being heated, i.e., poultry.

The object of the present invention is to create an improved version of a radiant tube heater to maximize radiant heat transfer in total from the product by changing temperature distribution down the length of the tube and maximizing 'line of sight' availability of the EM radiation at the floor level and to minimize or eliminate the traditional 'egg-shaped' pattern of radiation.

SUMMARY OF THE INVENTION

The present invention is directed to a heater unit assembly for heating a building, such as an animal (or specifically a poultry) confinement building. The heater unit assembly comprises a device for providing a force of heated air and a radiant heating tube unit. The radiant heating tube unit includes a first extended radiant tube having a first proximal end, a second distal end and a wall, wherein the first proximal end is connected to the forced heated air supply device to enable the force of heated air to flow through the first extended radiant tube, wherein the wall of the first extended radiant tube comprises a generally round or circular cross section. The radiant heating tube unit further includes a second extended radiant tube having a first proximal end connected to the second distal end of the first extended radiant tube, a second distal end and a wall, wherein the wall of second extended radiant tube comprises a generally ellipsoidal cross section having a major axis and a minor axis, wherein the major axis is longer than the minor axis, such that the wall of the second extended radiant tube includes elongated side walls along the direction of the major axis, and wherein the major axis is positioned approximately perpendicular with respect to the floor of the building. The surface area and total mass for convection and conduction heat transfer of the first extended radiant tube is less than the surface area and total mass for convection and conduction heat transfer of the second extended radiant tube. This generates a higher velocity of forced heated air through the first extended radiant tube than the second extended radiant tube resulting in less time for convection heat transfer and, therefore, less heat conduction through the first extended radiant tube than the second extended radiant tube. This creates extended time for convection heat transfer and therefore more heat conduction in the second extended radiant tube, wherein more of the convection heat is transferred to the second extended radiant tube allowing more conduction heat through the wall of the second extended radiant tube, balancing the outer tube temperature between the first and second tubes. The heater unit assembly further includes a transition tube connecting the second distal end of the first extended radiant tube to the first proximal end of the second extended radiant tube and an open reflector located between the radiant heating tube unit and the ceiling, the open reflector including downwardly depending sides having lower edges, wherein the edges are positioned such that the edges do not extend lower than the minor axis of the second extended radiant tube, wherein the sides of the open reflector are positioned to receive and downwardly deflect the radiant heat emitting from the sidewalls of the second extended radiant tube.

In a radiant tube heater, such as described herein, three heat transfer mechanisms occur. First, there is convection of the combustion heated air through the length of the tube. Second, there is conduction of the heat through the tube walls. Third, there is radiant heat emitted from the tube wall surface. At the macro level, radiant energy is proportional to the tube surface temperature to the fourth power. Thus, the objectives of this invention are to influence the convection and conduction heat transfer processes to achieve consistent outer surface tube temperature and further to influence the "line of sight" visibility of the radiant surface through the reflector design and tube shapes.

Advantageously, the radiant heater of the present invention is adapted to direct more heat to the floor of the building to be heated. With its unique design using a first tube having a generally round cross sectional shape, transitioning to a second tube having a generally ellipsoidal cross sectional shape, the resulting heating pattern is characterized as "wide and long."

The open reflector is uniquely designed to achieve more consistent heat coverage throughout the building.

Further, the pre-heat time is cut significantly.

The radiant heater's ability to use fresh air from a side wall or attic helps it run cleaner and require less maintenance, and it runs consistently regardless of house ventilation and fans.

The heater of the present invention delivers more heat to the floor than any other heat in the 80,000 BTU/h category.

The radiant heater provides a long, oval heat pattern with no extreme hot spots.

The radiant heater provides less heat to the ceiling, maximizing radiant heat to the floor, allowing the ceiling of the building to stay cool, so there is no need to add an insulated board above the heater to protect the ceiling structure. In addition, fuel is not wasted by heating the ceiling.

Unlike the prior art heater, the present invention has the following characteristics:

- The approximate overall tube length is between 10 and 50 ft. in length or more;
- The use of one or more smaller diameter tubes in the tube chain reduces surface area to reduce radiant heat transmitted coupled with a higher velocity that also reduces heat transfer to and through the tubes.
- The use of one or more larger distal tubes increases surface area and reduces gas velocity to increase heat transfer through the tube resulting in higher temperatures and increased radiant energy.
- The shape of the larger distal tube, preferably an oval or a tear-drop, is optimized to maximize sideways radiant transmission. Various tube diameter ratios (distal/proximal) can be utilized to satisfy different firing rates and tube lengths.
- A transition section is provided to provide the connection between the round proximal tube(s) and the oval or tear-drop shaped distal tubes.
- The system has an 'open' reflector concept. In the prior art radiant tube heaters, the 'sides' of the open reflector typically extend down to the bottom of the tube effectively blocking line of sight from the tube to the sides. Although appropriate for the typical 'high' industrial applications, where elevated heat is required, when installed in the typical poultry house, this blocks the line of sight EM transmission available sideways to the floor. The open reflector concept utilized by the present invention simply stops the 'sides' of the open reflector at about mid-tube thus making much more of the tube surface area line of sight visible at the floor level. The open reflector concept further includes angles specifically selected to maximize radiant heat transfer from the oval tube. The open reflector shape is specific to the tube shape that in term maximizes radiant heat energy transmission from the system.

One particular reason why the radiant heater system of the present invention is preferred for poultry barns is that the system is designed to maximize the heated floor area to obtain the desired temperatures for poultry production. There is a preferred or desired temperature range for bird production, generally about 87° F. to 110° F. For a given amount of input energy, the goal is to maximize the conversion of that input energy into radiant energy providing the broadest area of floor coverage within that temperature region. Below 87° F., the birds will huddle because they are cold and use feed input energy to keep warm. Above the 110° F., the birds are too hot and will try to cool themselves by increasing their respiration rate—thus using energy in that fashion. Additionally if those hot areas are around feed and/or water stations, then the poultry may be less inclined to eat and drink causing other issues.

The objects and advantages of the invention will appear more fully from the following detailed description of the preferred embodiment of the invention made in conjunction with the accompanying drawings and attachments.

DETAILED DESCRIPTION OF THE INVENTION

While radiant heaters have a wide variety of uses, a preferred use and the preferred use for the present invention is for heating agriculture animal confinement facilities and particularly poultry barns. The description of the present invention will be directly applied to this field although it is within the scope of the present invention and it is assumed that the radiant heater of the present invention can be used for a variety of facilities and a variety of purposes.

Figure 1:
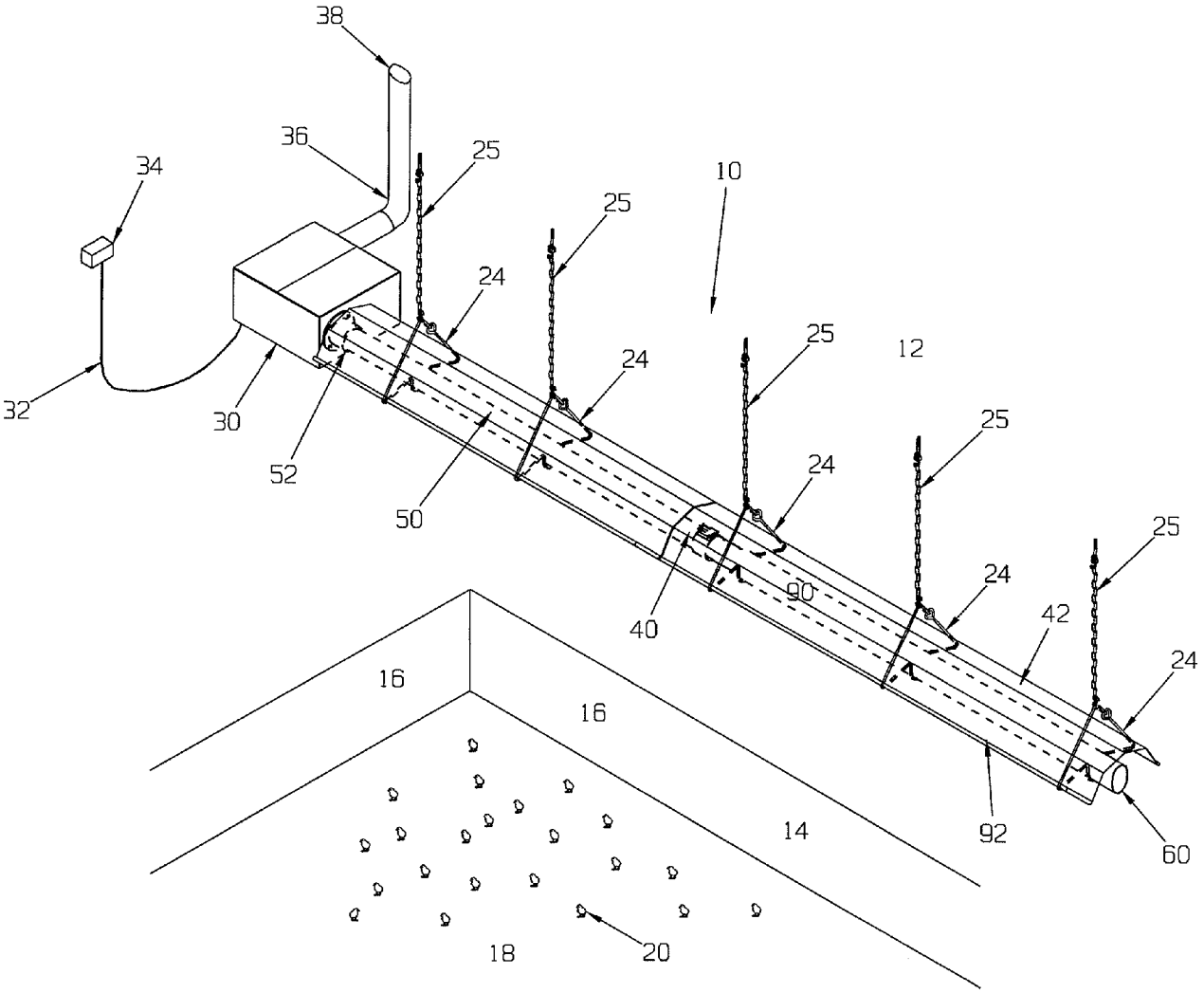
FIG. 1 is a perspective view of the interior of a building illustrating the radiant heater system of the present invention.

Reference is now made to FIG. 1, which illustrates the heater unit 10 attached to the ceiling 12 of a building 14, such as an agriculture or poultry barn. The building 14 includes sidewalls 16 and a floor 18. In a building 14, such as a poultry barn, the floor would include livestock, such as poultry 20.

The heater unit 10 of the present invention is comprised of three basic parts:

1) the heat creator or burner box 30, which includes an electric cord 32 attached to an electric outlet 34, an inlet tube 36 attached to the side of the burner box 30 for drawing air from the exterior of the building 14 to the heater unit 10, and a radiant heating tube unit 40 attached to the burner box 30 at the proximal end 52 of the first radiant tube 50. The inlet tube 36 is connected to an inlet tube opening 38 which may be included in the ceiling 12, as illustrated, or a side wall 16;

2) a heat distributor or radiant heating tube unit 40, including the first extended radiant tube 50 and the second extended radiant tube 60; and 3) an open reflector assembly 90.

The Heat Creator or Burner Box 30:

Heat creator or burner boxes 30 (referred throughout the disclosure as "burner box 30) are generally known to the art. The burner box 30 consists of a number of important components including the electronics, airflow components, fuel flow components, and safety devices.

The burner box 30 includes an enclosure with pressurized and non-pressurized sides, a gas control valve that may be either single stage or two stage, an orifice assembly; fan assembly incorporating a motor and fan wheel packaged in a sheet metal enclosure or housing; a spark ignition control and igniter components; burner assembly incorporating a venturi inlet style casting with expansion and contraction internal geometry coupled with a matrix of diffusion screens mounted at the discharge end; and an air proving switch as a safety device. The heater can run on liquid propane (LP) gas or natural gas. It provides 80,000 BTUH input per hour.

When the thermostat calls for heat, the ignition control performs a self-safety check by testing the internal components as well as the air pressure switch. After the safety check is completed, the fan motor starts, the igniter sparks, and will continue to spark until a flame is established. The second stage (if applicable) of gas controls opens based upon the thermostat.

The motor-driven centrifugal fan continually pulls fresh air into the burner box 30 and discharges it into a second chamber which becomes pressurized thus forcing part of the air to enter the burner assembly and the remainder to flow through the radiant heating tube unit 40. A fuel regulator is positioned upstream of the heater unit 10 to reduce the higher inlet pressure from the fuel supply source to a preset lower outlet pressure. The regulator supplies a steady outlet pressure to the heater unit 10 despite changes in the inlet pressure, heater demand, and weather conditions. The fuel flows into a gas control valve, which is an electrical device consisting of a low pressure regulator and electrical solenoids used for the control of gas flow to the burner chamber. The fuel flows into a burner orifice which feeds gas to the burner at a specific rate. The fuel and air mix in the burner and with the primary combustion air and fuel flow rates being tightly controlled, the resulting fuel and air mixture is at a ratio ideal for combustion. An igniter, positioned at the outlet of the burner, provides an ignition spark. The igniter assembly also serves as the flame sensor—when flame is established, the heater will continue to operate. The air flowing around the burner casting carries the flame partially down the length of the tube and becomes heated while in proximity with the flame. The radiant tube heater unit 10 will continue to operate as long as there is a call for heat.

A differential pressure switch in the burner box 30 operates as a safety device by verifying the fan functionality through continually monitoring the vacuum and positive pressures created by the airflow from the fan. If the fan fails or there is insufficient air flow through the burner box 30 to operate the vacuum switch will sense the lack of pressure differential across the switch and shut the heater down.

Figure 2:
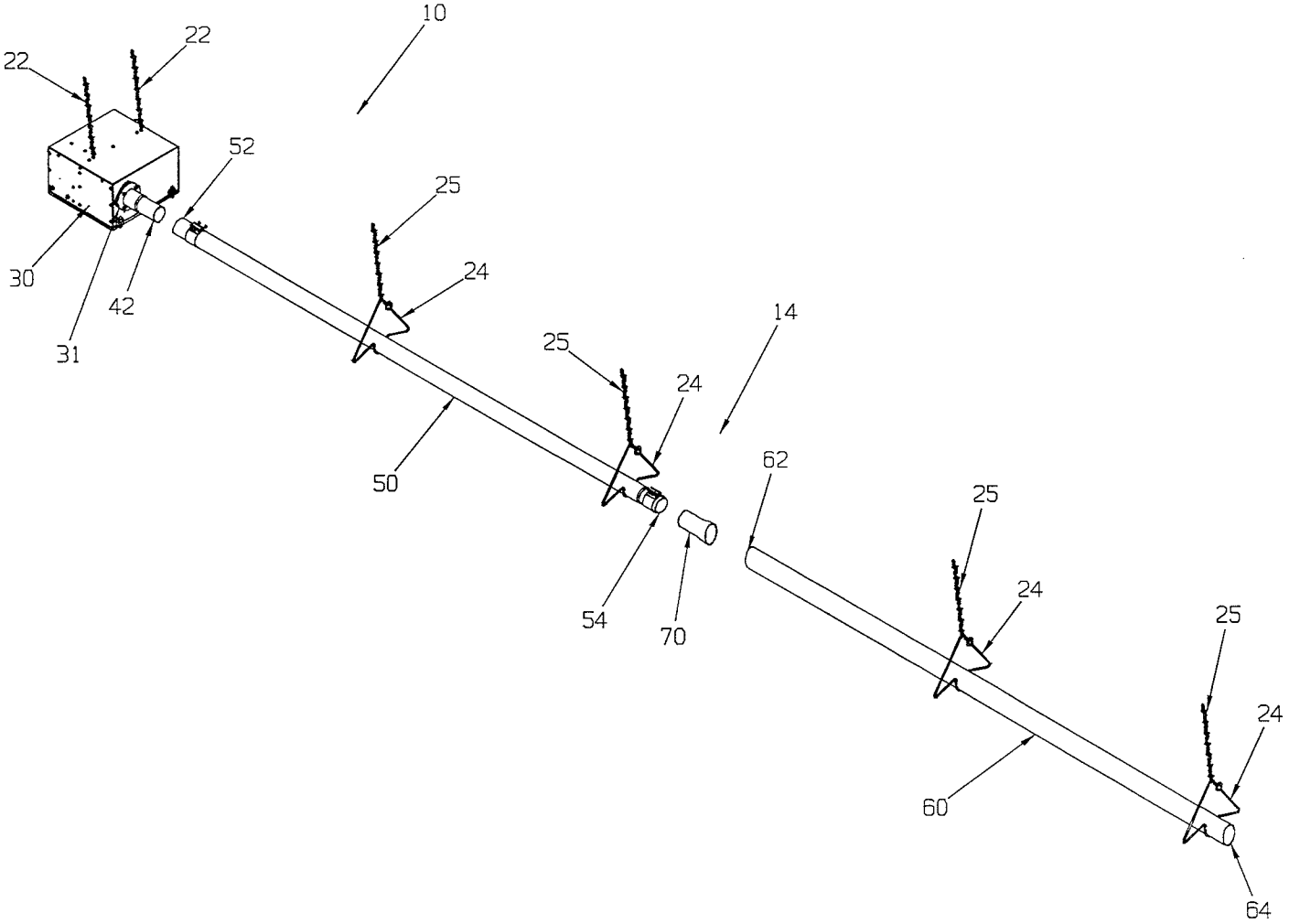
FIG. 2 is a perspective exploded view of the radiant tube heater of the present invention.

The burner box 30 generally hangs from the ceiling 12 or other structure and is supported by chains 25 or the like as illustrated in FIGS. 1 and 2.

The Heat Distributor or Radiant Heating Tube Unit 40:

The radiant heating tube unit 40 is generally a two part construction, which includes a first extended tube 50 connected in tandem to a second extended tube 60.

Figure 5A:
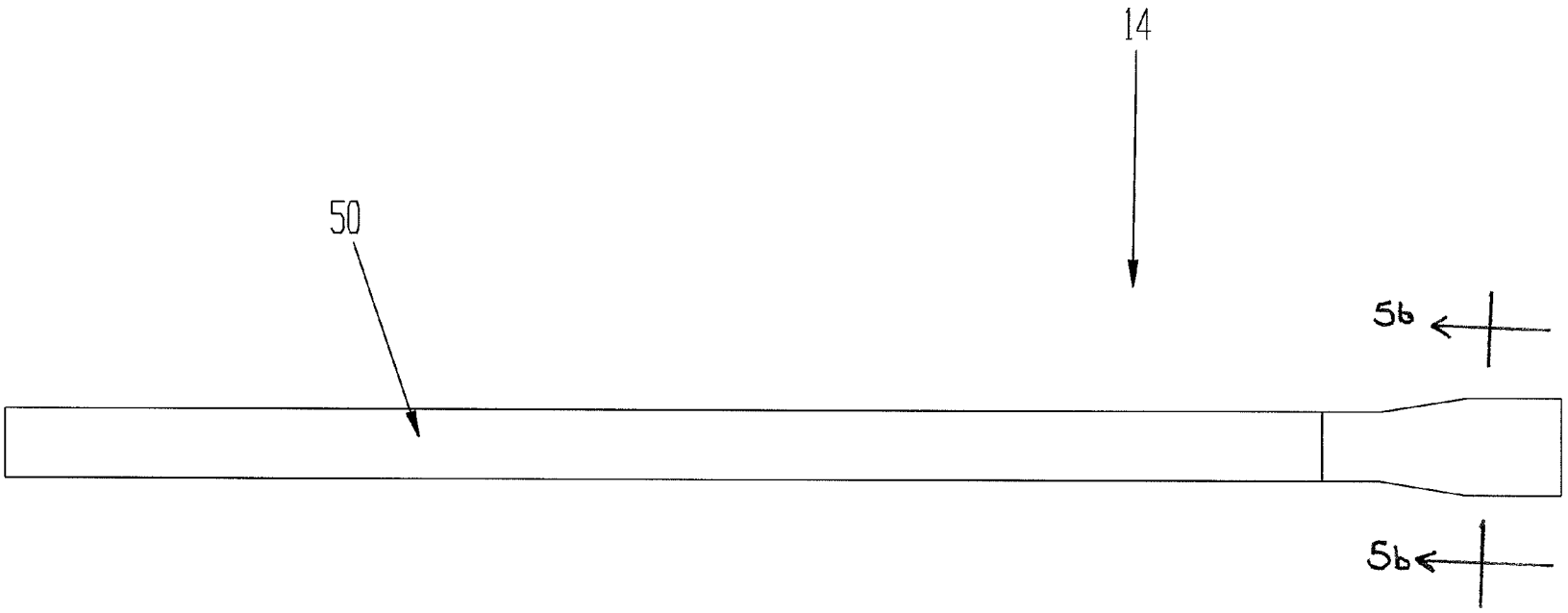
FIG. 5*a* is a side view of the heating tubes with preference given to the round tube.
Figure 5B:
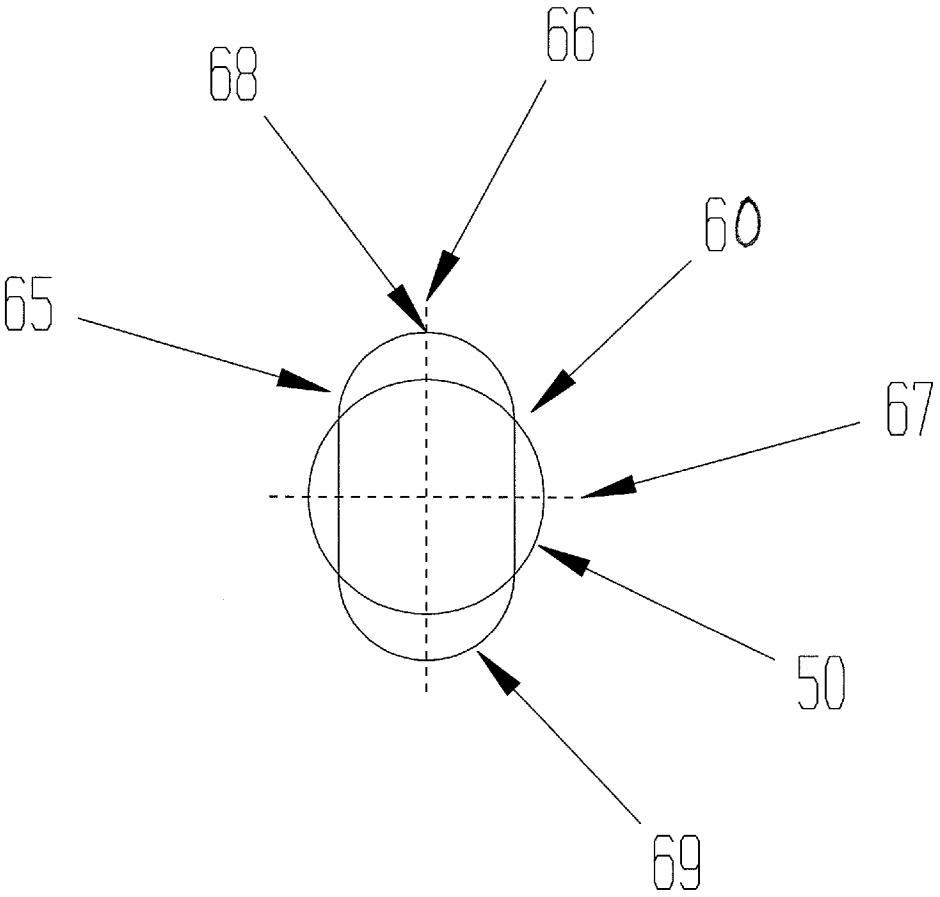
FIG. 5*b* is a cross-sectional view of the heating tube taken along lines 5*b*-5*b* of FIG. 5*a*.
Figure 6:
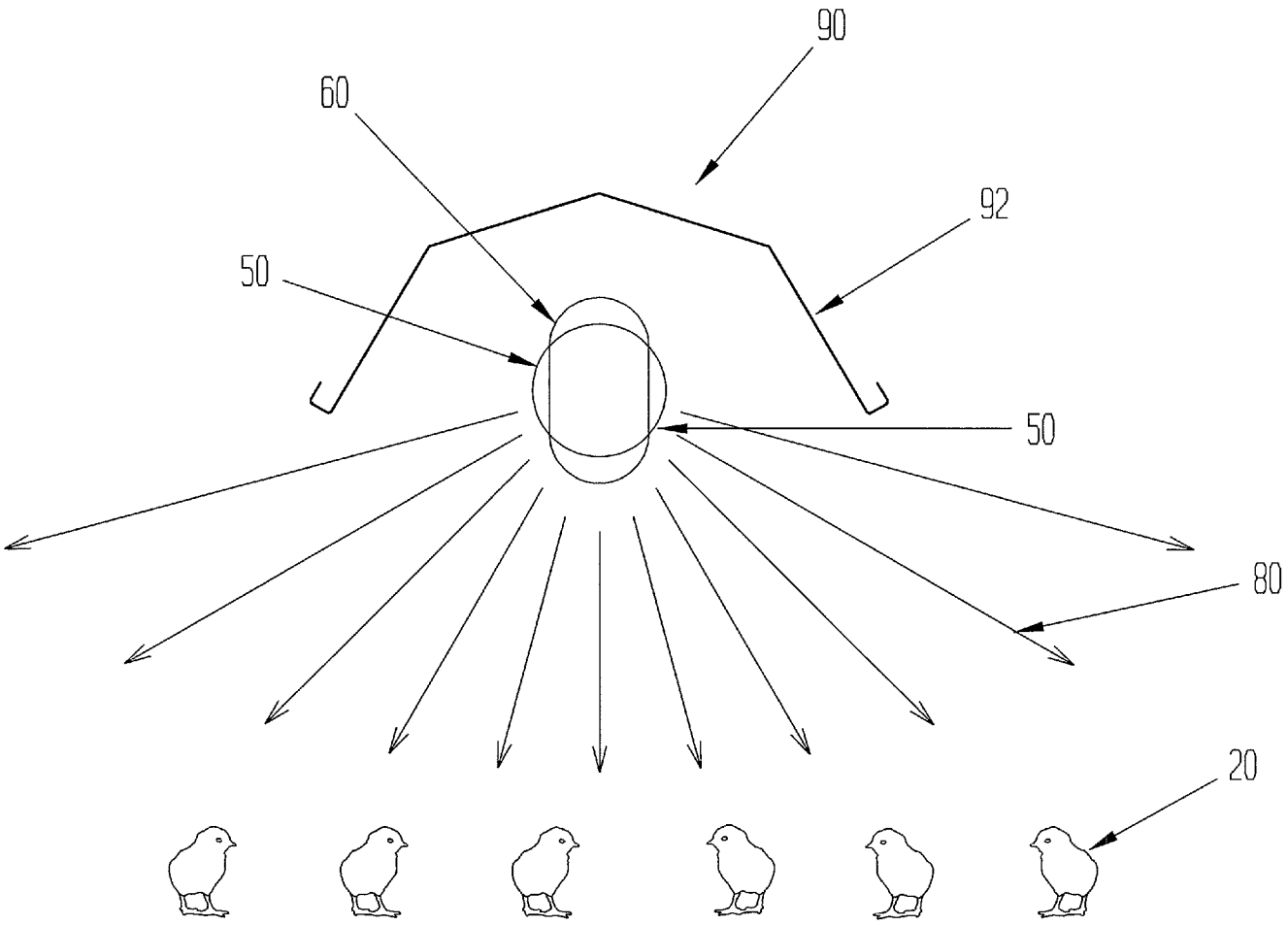
FIG. 6 is a cross-sectional view of the heating tubes and open reflector showing radiation lines.

The First Extended Tube 50:

The first extended tube 50 has a substantially circular or round cross-sectional shape, as illustrated in FIGS. 5*b* and 6. The first tube 50 is connected at its proximal end 52, to a discharge adapter 42 (see FIG. 2), which is attached to and extends from the burner box 30. Typical discharge adapters known to the art are 5 to 8 inches, preferably around 7.5, inches long and have a circumference of about 3 inches. The distal end 43 of the discharge adapter 42 may be crimped to receive the proximal end 52 of the first extended tube 50. The discharge adapter 42 of the burner box 30 assembly extends in generally parallel configuration to the ceiling 12. As an alternative configuration, the distal end 54 of the first tube 50 may be connected directly to the burner box 30 with a flange 31 thereby eliminating the discharge adapter 42. The first tube 50 is preferably a 3-inch diameter tube for the smaller rated burner boxes, i.e., 80,000 BTU. Higher rated burner boxes can have larger first tubes 50 connected to the burner box 30. For example, a 125,000 BTU heater unit 10 could have a round tube of 4-5 inches. For larger (or smaller) diameter tubes 50, the size of the distal end 43 of the discharge adapter 42 would have to be adjusted accordingly to accommodate the diameter of the first radiant tube 50. While first radiant tubes 50 with diameters between 3 and 5 inches are discussed and a tube having a diameter of 3 inches is especially preferred for the intended purpose of poultry maintenance, it is within the scope of the present invention to use first radiant tubes 50 having smaller or larger diameters depending on the requirements of the heater unit 10.

For purposes of the preferred aspect of this invention, the desired first extended tube 50 is a 3-inch round tube which transitions to a 4-inch (along the major axis 68) oval second extended tube 60. With the 3-inch radiant tube 50, smaller than a typical 4-inch tube, the heat transfer through the first radiant tube 50 is reduced thereby lowering the first radiant tube 50 temperatures which is an advantage to the system. This equates to less surface area and less total mass for convection and conduction heat transfer to the outer surface of the first radiant tube 50. The temperature of the outer tube surface determines the amount of radiant energy available for transmission.

At the macro level, radiant energy is proportional to the tube temperature to the fourth power. With a higher velocity of the heated air mass through the first radiant tube 50 resulting in less resident time, there is less time for the heat transfer to occur. The net impact is lower peak tube temperatures and more consistent tube temperature in the 3-inch round section with one of the benefits then being minimizing the typical hot spot under the first radiant tube 50 section. The smaller 3-inch round radiant tube 50 quickly pushes heat into the second oval-shaped radiant tube 60, minimizing the hot spot under the first radiant tube 60.

The length of the first radiant tube 50 is variable and depends on the needs associated with the environment, i.e., building, and the input rating of the burner box 30. For purposes of the present invention, the length of the first radiant tube 50 is typically between about 5 and 25 feet and preferably about 10 feet long.

Transition Adapter 70:

Situated at the distal end 54 of the first radiant tube 50 is a transition adapter or tube 70 which provides transitional fitting from the first radiant tube 50 to the second radiant tube 60. The transition adapter 70 includes a first opening 72 having a cross-sectional shape and diameter size similar to the circular cross-sectional shape of the distal end 54 of the first radiant tube 50. The transition adapter 70 further includes a second opening 74 having a cross-sectional shape and size similar to the proximal end 62 of the second radiant tube 60. It is within the scope of the present invention to provide the transition adapter 70 with means to sealingly engage the first and second radiant tubes 50, 60. For example, the first opening 72 of the transition adapter 70 can be made slightly larger than the distal end 54 of the first radiant tube 50 to allow the first opening 72 of the transitional adapter 70 to slidably and sealingly engage over a portion of the distal end 54 of the first radiant tube 50. A similar arrangement is contemplated for the second opening 74 of the transition adapter 70 and the proximal end 62 of the second radiant tube 60.

Figure 7:
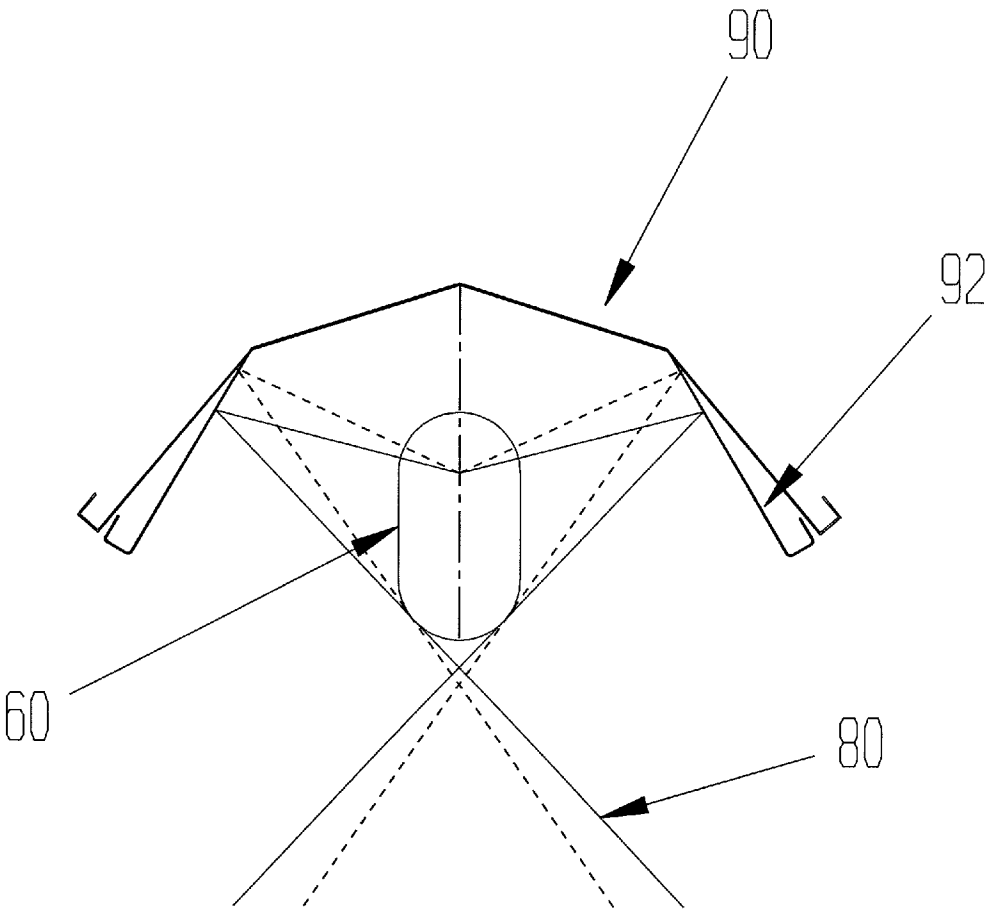
FIG. 7 is an alternative cross-sectional view of the heating tube and open reflector showing radiation lines.

The Second Radiant Tube 60:

Unlike the first radiant tube 50, the second radiant tube 60 has a cross section which is not circular, but generally ellipsoidal or oval in shape, as illustrated in FIGS. 5*b*, 6 and 7, such that the cross section includes elongated generally parallel-disposed walls 65 positioned in a generally perpendicular fashion with respect to the surface to be heated, generally the floor 18 of the building 14. By "ellipsoidal," it is meant that the cross section of the second radiant tube 60 does not have a diameter, such as a circle, but has two diameters, i.e., a major axis 66 and a minor axis 67, as illustrated in FIG. 5*b*. This forms an elongation of the outer side walls 65 along the direction of the major axis 66 and a shorter upper wall 68 and bottom wall 69 along the direction of the minor axis 67.

Like the first radiant tube 50, the second radiant tube 60 is situated in generally parallel position to the ceiling 12. The purpose of the second radiant tube 60 is to maximize the radiant heat transmission, indicated by arrows 80 in FIG. 6, to the side walls 65 of the second radiant tube 60 due to the increased surface area directed to the side walls 65. In this manner, the shape of the second radiant tube 60 achieves a higher radiance emission than the first radiant tube 50.

As illustrated in FIG. 5*b*, the width of the second radiant tube 60 along the minor axis 67 is preferably the same or similar to, either larger or smaller, than the diameter of the first radiant tube 50. In addition, the cross-sectional length of the second radiant tube 60, along the major axis 66 is longer than the diameter of the first radiant tube 50. Thus, for a radiant tube unit 40, wherein the diameter of the first radiant tube 50 is approximately 3 inches, the width of the second radiant tube 60, along the minor axis will also be approximately 3 inches or longer. The length of the second radiant tube 60, along the major axis 66 will be longer to provide the ellipsoidal shape necessary for creating the sidewall 65 shape of the second radiant tube 60.

For purposes of this invention, the second radiant tube 60 is preferably an oval shape having side walls 65 longer than the opposing upper and bottom walls 68, 69. The second radiant tube 60 does not necessarily have to have an oval cross-sectional shape. However, it is required to have longer side walls 65 such that it has more radiant lines of emission 80 radiating from the side walls 65 versus the bottom wall 69 or top wall 68 of the second radiant tube 60. Thus, the cross-sectional shape of the second radiant tube 60 can be any of a number of configurations, such as egg shape, tear drop shape, hexagonal, etc.

Advantageously, the ellipsoidal-shaped second radiant tube 60 maximizes the radiant heat transmission to the side walls 65 of the second radiant tube 60 due to increased surface area radiating to the side walls 65. The length of the second radiant tube 60, like the first radiant tube 50, is variable between about 5 feet and 25 feet, and preferably about 10 feet long.

The heated air mass transitions from the smaller first radiant round-shaped tube 50 to the larger second radiant ellipsoidal-shaped tube 60. This causes the air mass flowing through the second radiant tube 60 to slow allowing increased time for the convection and conduction heating process to occur. There is more surface area and more total mass for the conduction and transfer processes to occur. The net impact with the transition from the smaller diameter first radiant tube 50 to the second radiant tube 60 is more consistent tube temperatures over the total length of the radiant heating tube unit 40 resulting in a more consistent heat pattern emanating from the heater unit 10. The benefit results from the decreased surface area on the top and bottom walls 68, 69 of the second radiant tube 60 coupled with increased surface area to the side walls 65 due to its ellipsoidal shape. Thus, there is comparatively more heat radiating to the side walls 65 of the second radiant tube 60 and less directly to the top and bottom walls 68, 69. By making the heat transfer over the length of the radiant heating tube unit 40 consistent, maximizing total heat transfer through the radiant heating tube unit 40 and then optimizing the shape of the second radiant tube 60, the maximum amount of input energy is converted into a broad heating pattern, illustrated in FIGS. 6 and 7, with minimal heat loss to the ceiling 12 and minimal area of the floor 18 surface that is too hot for the animals. This decreases the amount of heat emanating to the ceiling 12, which allows for a more efficient distribution.

Figure 4:
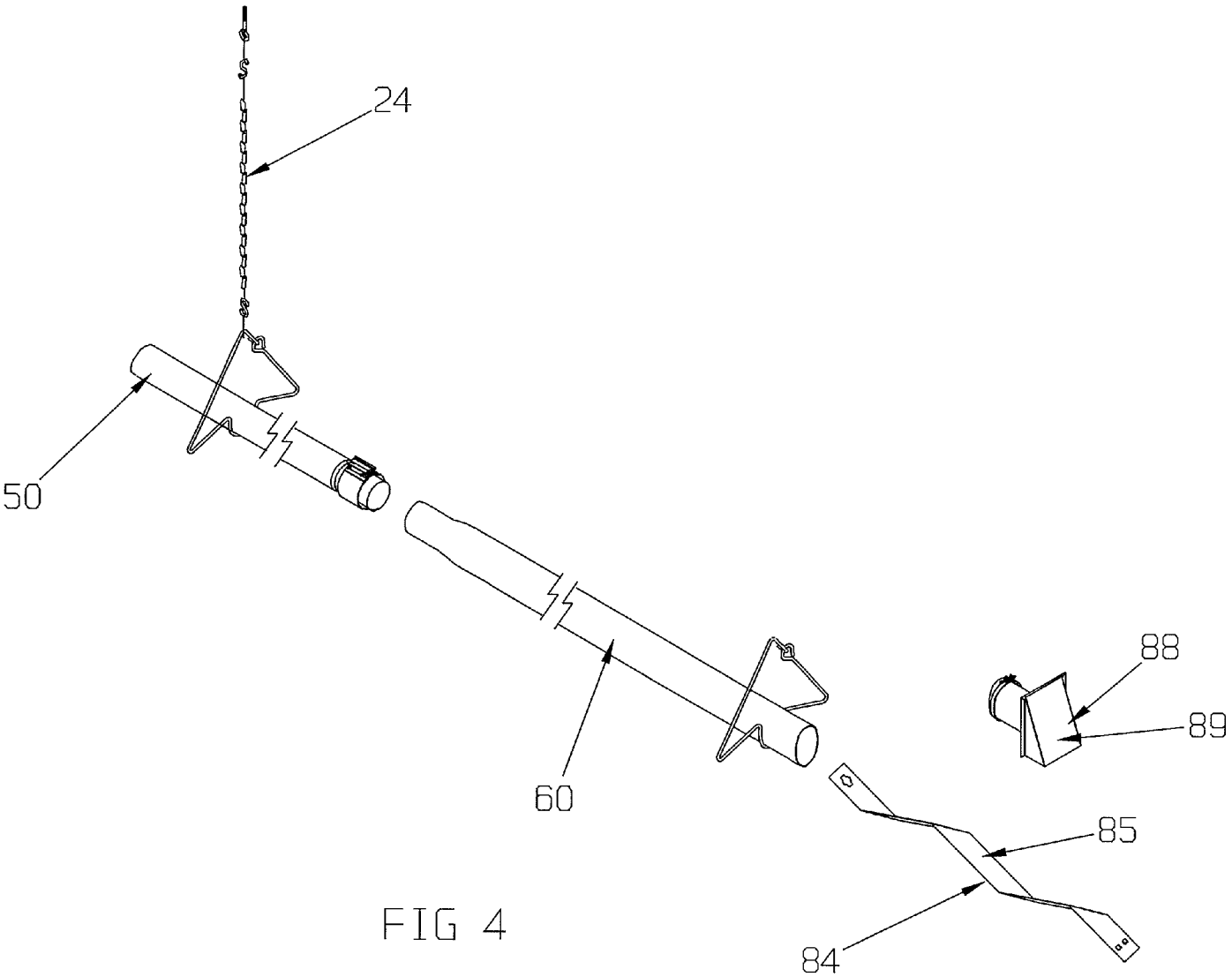
FIG. 4 is an exploded view of the radiant tube heater of the present invention.

Air Turbulation Strip 84:

As the convection heat moves down the overall length of the tubes it tends to contract towards the center of the tube. Referring to FIG. 4, an air turbulation strip 84 is preferably placed within the second tube 60 in order to redirect the convection heat energy to the inner surface of the side walls 65 to further heat conduction through the second tube 60 which in turn direct the radiant energy outwardly beyond the second radiant tube 60 side walls 65 to provide heat to the building 14. The air turbulation strip 84 includes a series of contiguous angled deflecting fins 85, which deflect the convection heat energy toward the inner surface of the side walls 65.

Vent Hood 88:

Located at the distal end 64 of the second radiant tube 60 is a vent hood 88 which includes a downwardly directed louver 89 designed to direct the flow of heat downwardly, illustrated in FIG. 4. The opening or mouth of the louver 89 preferably includes a rotatable closure device or flapper designed to seal off the louver mouth when there are no gases exiting the second radiant tube 60. When exhaust gases pass through the second radiant tube 60 and out the louver mouth, the rotatable closure device will rotate into an open position to direct heat toward the floor of the building.

Hangers:

Illustrated in FIGS. 1-4, both radiant tubes 50, 60 are supported by hanger assemblies 24, which are preferably configured to receive either the rounded shape of the first radiant tube 50 or the ellipsoidal shape of the second radiant tube 60. The hanger assemblies 24 are secured to the ceiling 12 by means of securing chains 25 or the like.

Open Reflector 90:

Situated above the radiant heating tube unit 40 is an open reflector 90, as illustrated in FIGS. 1, 3, 6 and 7. The shape of the open reflector 90 has been modified from the prior art to enhance the radiating ability of the second radiant tube 60 heating capability. The prior art reflector often included a V-shaped dust trap (not illustrated). In addition, the sides 92 of the open reflector 90 extended to the bottom of the radiant heating tube unit 40. The open reflector 90 of the present invention is different in that it does not have a dust trap and the sides 92 of the open reflector 90 end no further than the midpoint, defined by the minor axis 67, of the side walls 65 of the radiant heating tube unit 40. For this reason, the open reflector 90 is known as an "open reflector." In addition, the sides 92 of the open reflector 90 are positioned at a more acute angle with respect to the prior art reflector. This enhances the radiance of the radiant heating tube unit 40, as illustrated in FIG. 7.

The open reflector 90 is typically manufactured from highly polished aluminum sheet and mounts above the radiant heating tube unit 40, held in position with hangers 24. The open reflector 90 incorporates specific angles relative to the tube shape to maximize sideways radiant heat transmission 80. The unique open reflector design maximizes the heat transfer to the side walls 65, and minimizes the transfer of heat directly below. The reflector system is an 'open' concept with angles specifically selected to maximize radiant heat transfer from the radiant heating tube unit 40. The open reflector shape is specific to the tube shape to maximize radiant heat energy transmission from the system. This is shown with respect to the lines of radiation 80 in FIG. 7. As illustrated in FIG. 7, the lines of radiation 80 have a much broader spread thereby heating a greater area of the building 14.

Operation of the Heater Unit 10:

The core concept of the invention is as follows: The first section of the radiant heating tube unit 40 uses a smaller diameter first radiant tube 50. This causes the mass of heated air generated by the burner box 30 to flow faster through the first radiant tube 50 than if the first radiant tube 50 was larger or the same size as the second radiant tube 60. Therefore, heat transfer or radiance outside the first radiant tube 50 is reduced to make that heat more available in the second radiant tube 60. Because the smaller diameter first radiant tube 50 has less size and surface area, the heat will transmit through it faster.

There is then the transition from the first radiant tube 50 to the second radiant tube 60. As the heated air reaches the second radiant tube 60, via the transition tube 70, the air slows down because there is a larger area for the heat to enter. The air turbulation strip 84 assists in redirecting the heated air to the side walls 65 of the second radiant tube 60. In the second radiant tube 60, there is a higher concentration of emission lines 80 in the longer side walls 65 of the second radiant tube 60 than in the smaller diameter first radiant tube 50. This equates to a greater heat emission in the second radiant tube 60.

Advantageously, the smaller first radiant tube 50 causes the heat from the burner box 30 to pass quickly into the second radiant tube 60, minimizing the hot spot directly under the unit 10. In a preferred embodiment, the 3-inch round first radiant tube 50 transitions to a 4-inch (along the major axis 68) second radiant tube 60 delivering a long, wide, oval heat pattern, not an egg-shaped pattern. There will be an increase in the transition size from the first radiant tube 50 to the second radiant tube 60. The total surface area of emission will be greater because it is desired to force more of the radiant energy through the first radiant tube 50 and into the second radiant tube 60.

The preferred embodiment of the new invention is directed to a two-part radiant heating tube unit 40, wherein the first radiant tube 50 exiting the burner box 30 is an approximately 10 foot long, 3 inch diameter round first radiant tube 50. The round radiant tube 50 transitions, by transition piece 70, into a larger second radiant tube 60 having a non-round or preferably oval cross-section. This second radiant tube 60 is preferably about 10 feet long. Therefore, the combined length of the radiant tube 40, including tubes radiant tubes 50 and 60 is approximately 20 feet in length. With a burner box 30 having an 80,000 BTU capacity, the 20 foot long radiant heating tube unit 40 is sufficient. Longer rooms may require several heating units 10. A burner box 30 with a larger BTU output will be able to accommodate a longer radiant tube unit 40.

While the above dimensions may be considered preferred, it is within the scope of the present invention to incorporate other dimensions. The diameters of the radiant heating tubes 50, 60 can be larger or smaller than the dimensions expressed above. Additionally, the lengths of the radiant heating tubes 50, 60 can also vary. The importance to the concept is that the round first radiant tube 50 has a smaller diameter than the diameter (or width) of the second radiant tube 60 to effect a forced or faster transition of the heated air into the second radiant tube 60. The importance of the second radiant tube 60 is that the side walls 65 have a greater surface area than the top and bottom walls 68, 69 which enhances the emission lines of the radiant heat, illustrated by arrows 80. While an oval shape is currently being used and may be preferred, other shapes are contemplated, such as tear drop, hexagonal (with flat sides), egg shape, etc.

Figure 3:
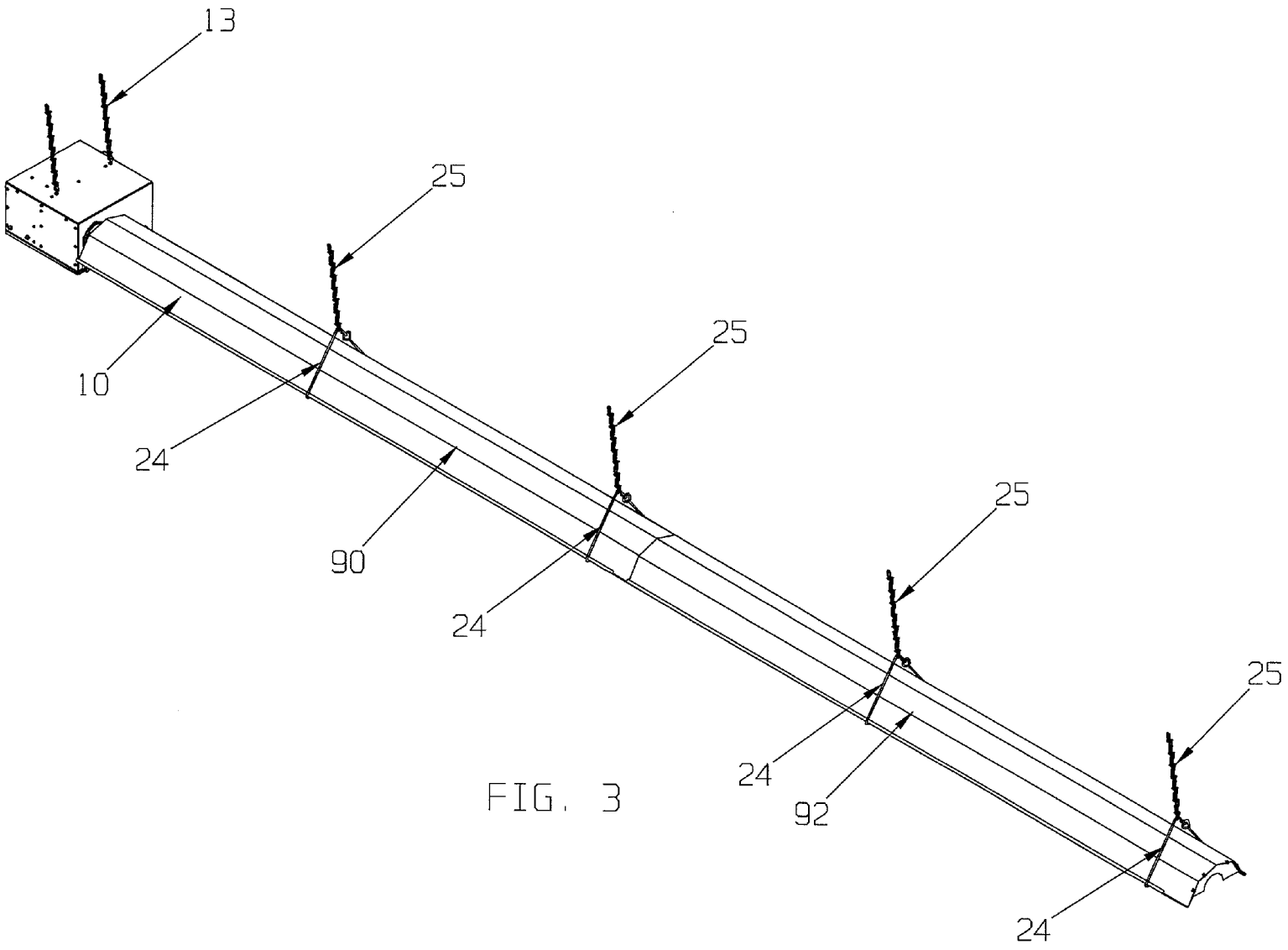
FIG. 3 is a perspective view of the radiant tube heater of the present invention with the attached open reflector.

Installation:

To install, the burner box 30 is hung from the ceiling 12 by hanger 24 or the like, illustrated in FIGS. 1-3, at an appropriate length from the ceiling 12 to maintain proper clearance.

The round first radiant tube 50 is attached to the burner box 30 opening by a clamp or the like (FIGS. 1 and 2). The round first radiant tube 50 is then positioned in parallel to the ceiling 12 and secured by hangers 24 also attached to the ceiling 12 by chains 25 or the like.

Situated at the distal end 54 of the round first radiant tube 50 is a transition tube 70 which allows for the transitioning of the round first radiant tube 50 to the ellipsoidal second radiant tube 60. The second radiant tube 60 is then attached to the transition tube 70 and hung in parallel with the ceiling 12 by hangers 24 as illustrated in FIG. 1. While it is preferred to hang the heater unit 10 assembly level or in parallel with the ceiling 12, it is also within the scope of the present invention to hang the heater unit 10 at a downward slope away from the burner box 30 not exceeding 1 inch for every 10 feet of radiant heating tube unit 40.

The open reflector 90 is then installed over the radiant heating tube unit 40, as illustrated in FIG. 3. The open reflector 90 is then secured to the burner box 30 and maintained in parallel disposition to the radiant heating tube unit 40 and the ceiling 12 with the assistance of the hangers 24.

A thermostat or building controller (not illustrated) is then connected to the burner box 30 and attached to the wall 16 of the building 14 to be heated.

Any version of any component or method step of the invention may be used with any other component or method step of the invention. The elements described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") and websites cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such process steps and materials may vary somewhat. It is also understood that the terminology used herein is used for the purpose of describing particular embodiments only and is not intended to be limiting since the scope of the present invention will be limited to only the appended claims and equivalents thereof.

What is claimed is:

1. A heater unit assembly for heating a building, comprising a floor, ceiling and side walls, the heater unit assembly comprising:

a. a forced heated air supply comprising means for providing a force of heated air;

b. a radiant heating tube unit, comprising:

i. a first extended radiant tube having a wall and a first proximal end and a second distal end, wherein the first proximal end is connected to the forced heated air supply to enable the force of heated air to flow through the first extended radiant tube, wherein the wall of the first extended radiant tube comprises a generally round or circular cross section, and ii. a second extended radiant tube having a wall and a first proximal end connected to the second distal end of the first extended radiant tube and a second distal end, wherein the wall of second extended radiant tube comprises a generally ellipsoidal cross section having a major axis and a minor axis, wherein the major axis is longer than the minor axis, such that the wall of the second extended radiant tube includes elongated side walls along the direction of the major axis, wherein the major axis is positioned approximately perpendicular with respect to the floor of the building;

wherein the surface area and total mass for convection and conduction heat transfer of the first extended radiant tube is less than the surface area and total mass for convection and conduction heat transfer of the second extended radiant tube to generate a higher velocity of forced heated air through the first extended radiant tube than the second extended radiant tube resulting in less time for convection heat transfer and less heat conduction through the first extended radiant tube than the second extended radiant tube, creating extended time for convection heat transfer in the second extended radiant tube, wherein more convection heat is transferred to the second extended radiant tube and more conduction heat is transferred through the wall of the second extended radiant tube.

2. The heater unit assembly of claim 1, wherein the building is an agriculture animal confinement building.

3. The heater unit assembly of claim 1, wherein the building is a poultry confinement building.

4. The heater unit assembly of claim 1, wherein the forced heated air supply comprises a burner box, including means for drawing air from the exterior of the building and means for heating air and a discharge adapter, wherein the first proximal end of the first extended radiant tube is connected to the discharge adapter.

5. The heater unit assembly of claim 1, wherein the first proximal end of the first extended radiant tube is connected directly to the burner box with a flange.

6. The heater unit assembly of claim 1, wherein the diameter of the first extended radiant tube is between about 3 inches and 5 inches.

7. The heater unit assembly of claim 1, wherein the diameter of the first extended radiant tube is 3 inches.

8. The heater unit assembly of claim 1, wherein the length of the first extended radiant tube is between about 1 foot and 25 feet.

9. The heater unit assembly of claim 1, wherein the length of the second extended radiant tube is between about 5 feet and 25 feet.

10. The heater unit assembly of claim 1, wherein the lengths of the first and second extended radiant tube are 10 feet each.

11. The heater unit assembly of claim 1, wherein the width of the second extended radiant tube along its minor axis is substantially equal to the diameter of the first extended radiant tube.

12. The heater unit assembly of claim 1, further comprising a transition tube connecting the second distal end of the first extended radiant tube to the first proximal end of the second extended radiant tube.

13. The heater unit assembly of claim 1, wherein the shape of the cross section of the second extended radiant tube is selected from one of the following shapes: egg shape, tear drop shape, hexagonal shape, and octagonal shape.

14. The heater unit assembly of claim 1, further comprising an air turbulation strip placed within the second extended radiant tube, the air turbulation strip comprising at least angle deflecting fin for directed radiant energy toward the sidewalls of the second extended radiant tube.

15. The heater unit assembly of claim 1, further comprising a vent hood connected to the distal end of the second extended radiant tube, the vent hood comprising a downwardly directed louver to direct heat toward the floor of the building.

16. The heater unit assembly of claim 15, wherein the downwardly directed louver includes a rotatable discharge closure device adapted to rotate into an open position to discharge exhaust gases.

17. The heater unit assembly of claim 1, further comprising hangers for attaching the heater unit assembly to the ceiling of the building.

18. The heater unit assembly of claim 17, wherein the hangers are configured to receive the shapes of either the first or second extended radiant tube.

19. The heater unit assembly of claim 1, further comprising an open reflector located between the radiant heating tube unit and the ceiling, the open reflector including downwardly depending sides having lower edges, wherein the edges are positioned such that the edges do not depend lower than the minor axis of the second extended radiant tube, wherein the sides of the open reflector are positioned to receive and downwardly deflect the radiant heat emissions penetrating the sidewalls of the second extended radiant tube.

20. The heater unit assembly of claim 19, wherein the open reflector is comprised of a highly reflective material.

21. A heater unit assembly for heating a building, comprising a floor, ceiling and side walls, the heater unit assembly comprising:

a. a forced heated air supply comprising means for providing a force of heated air;

b. a radiant heating tube unit, comprising:

i. a first extended radiant tube having a wall and a first proximal end and a second distal end, wherein the first proximal end is connected to the forced heated air supply to enable the force of heated air to flow through the first extended radiant tube, wherein the wall of the first extended radiant tube comprises a generally round or circular cross section and the diameter is between about 3 and 5 inches, and a second extended radiant tube having a wall and a first proximal end connected to the second distal end of the first extended radiant tube and a second distal end, wherein the wall of second extended radiant tube comprises a generally ellipsoidal cross section having a major axis and a minor axis, wherein the major axis is longer than the minor axis, such that the wall of the second extended radiant tube includes elongated side walls along the direction of the major axis, wherein the major axis is positioned approximately perpendicular with respect to the floor of the building, wherein the width of the second extended radiant tube along its minor axis is substantially equal to the diameter of the first extended radiant tube;

ii. a transition tube connecting the second distal end of the first extended radiant tube to the first proximal end of the second extended radiant tube; and c. an open reflector located between the radiant heating tube unit and the ceiling, the open reflector including downwardly depending sides having lower edges, wherein the edges are positioned such that the edges do not depend lower than the minor axis of the second extended radiant tube, wherein the sides of the open reflector are positioned to receive and downwardly deflect the radiant heat emissions penetrating the sidewalls of the second extended radiant tube;

wherein the surface area and total mass for convection and conduction heat transfer of the first extended radiant tube is less than the surface area and total mass for convection and conduction heat transfer of the second extended radiant tube to generate a higher velocity of forced heated air through the first extended radiant tube than the second extended radiant tube resulting in less time for convection heat transfer and less heat conduction through the first extended radiant tube than the second extended radiant tube, creating extended time for convection heat transfer in the second extended radiant tube, wherein more convection heat is transferred to the second extended radiant tube and more conduction heat is transferred through the wall of the second extended radiant tube.

22. The heater unit assembly of claim 21, wherein the building is a poultry confinement building.

23. The heater unit assembly of claim 21, wherein the forced heated air supply comprises a burner box, including means for drawing air from the exterior of the building and means for heating air and a discharge adapter, wherein the first proximal end of the first extended radiant tube is connected to the discharge adapter.

24. The heater unit assembly of claim 21, wherein the diameter of the first extended radiant tube is 3 inches.

25. The heater unit assembly of claim 21, wherein the length of the first extended radiant tube is between about 1 foot and 25 feet and the length of the second extended radiant tube is between about 5 feet and 25 feet.

26. The heater unit assembly of claim 21, further comprising an air turbulation strip placed within the second extended radiant tube, the air turbulation strip comprising at least angle deflecting fin for directed radiant energy toward the sidewalls of the second extended radiant tube.

27. The heater unit assembly of claim 21, further comprising a vent hood connected to the distal end of the second extended radiant tube, the vent hood comprising a downwardly directed louver to direct heat toward the floor of the building.

28. The heater unit assembly of claim 27, wherein the downwardly directed louver includes a rotatable discharge closure device adapted to rotate into an open position to discharge exhaust gases.

* * * * *